US010883722B2

(12) United States Patent
Crowe

(10) Patent No.: US 10,883,722 B2
(45) Date of Patent: Jan. 5, 2021

(54) ELECTRIC FIREPLACE LIGHTING SYSTEM

(71) Applicant: Twin-Star International, Inc., Delray Beach, FL (US)

(72) Inventor: Matthew Crowe, Dongguan (CN)

(73) Assignee: Twin-Star International, Inc., Delray Beach, FL (US)

( * ) Notice: Subject to any disclaimer, the term of this patent is extended or adjusted under 35 U.S.C. 154(b) by 998 days.

(21) Appl. No.: 15/155,316

(22) Filed: May 16, 2016

(65) Prior Publication Data

US 2017/0328575 A1 Nov. 16, 2017

(30) Foreign Application Priority Data

May 10, 2016 (CN) ..... 2016 1 0306066

(51) Int. Cl.
*F24C 7/00* (2006.01)
*F21S 10/04* (2006.01)
*F24B 1/18* (2006.01)

(52) U.S. Cl.
CPC ..... *F24C 7/004* (2013.01); *F21S 10/046* (2013.01); *F24B 1/1808* (2013.01)

(58) Field of Classification Search
CPC . F24C 7/004; F21S 10/046; F21S 4/10; F24B 1/1808; F21W 2121/00; F21Y 2115/10; Y10S 362/806; A47G 33/06
USPC ..... 362/806
See application file for complete search history.

(56) References Cited

U.S. PATENT DOCUMENTS

2005/0252051 A1* 11/2005 Chen ..... F24C 7/004 40/428
2007/0175074 A1* 8/2007 O'Neill ..... F24C 7/004 40/428
2008/0028648 A1* 2/2008 O'Meill ..... F24C 7/004 40/428

FOREIGN PATENT DOCUMENTS

| | | |
|---|---|---|
| CN | 202521701 | 11/2012 |
| CN | 202708963 | 1/2013 |
| CN | 204115059 | 1/2015 |
| CN | 104456694 | 3/2015 |
| CN | 105910157 | 8/2016 |

* cited by examiner

*Primary Examiner* — Cara E Rakowski
*Assistant Examiner* — Jessica M Apenteng
(74) *Attorney, Agent, or Firm* — McDonald Hopkins LLC

(57) ABSTRACT

A lighting system for an electric fireplace, and a fireplace assembly including such system, may include a plurality of logs arranged in different orientations and in different rows. Some of the logs may include a substantially planar surface facing forwards. A front projector may project a lighting effect onto the logs, including the substantially planar surfaces, and a rear projector may project a lighting effect onto a non-transparent screen positioned behind the plurality of logs. The lighting system desirably provides a realistic three-dimensional flame effect in conjunction with a log set having a natural, split-log appearance. Other features may be included to enhance the lighting system, including internal lights in the logs and in an ember bed, as well as coloration of the logs to enhance the lighting effects and the natural appearance of the logs.

20 Claims, 12 Drawing Sheets

ELECTRIC FIREPLACE LIGHTING SYSTEM

CROSS-REFERENCE TO RELATED APPLICATION

This application claims priority to Chinese Patent Application No. 201610306066.2, filed May 10, 2016, the disclosure of which is hereby incorporated by reference.

BACKGROUND OF THE INVENTION

Electric fireplaces, which simulate the look of wood-burning fireplaces, are known. Lighting effects may be used in these fireplaces to mimic aspects of illumination patterns that are observed in real, wood-burning fires. The present invention includes an improvement of such lighting effects and enhances the appearance of a simulated fire.

BRIEF SUMMARY OF THE INVENTION

One aspect of the present invention provides an electric fireplace assembly. The electric fireplace assembly may have a front portion and a rear portion. According to this aspect of the invention, the electric fireplace assembly may include a plurality of logs, a non-transparent screen, a front projector, and a rear projector. At least one of the logs may have a substantially planar surface facing the front of the fireplace. The non-transparent screen may be positioned behind the plurality of logs toward or at the rear of the fireplace. The front projector is desirably for projecting light onto at least a portion of the substantially planar surface of one or more of the logs to provide the appearance of a burning log. The rear projector is desirably for projecting light onto the screen behind the logs to provide a further appearance of a burning log.

In accordance with further aspects of the invention, multiple front projectors may be provided. Moreover, multiple projectors of the fireplace assembly may be synchronized. For example, the front projector may include a front light source and a rotatable front spinner, and the rear projector may include a rear light source and a rotatable rear spinner. The front and rear spinners may be configured to reflect light from the respective front and rear light sources. In accordance with one aspect of the invention, the fireplace assembly may include a rotation control system for synchronizing rotation of the front and rear spinners.

In accordance with yet further aspects of the invention, at least two of the logs extend along different axes, which axes may be transverse to one another. Additionally, or alternatively, the axis of one of the logs may be positioned in front of the axis of another one of the logs. The front projector may be configured to project light onto at least a portion of an ember bed positioned below the logs. At least one of the logs may include a lighting source within it. The substantially planar surface of at least one of the logs may have a different color than other portions of that log.

Another aspect of the present invention provides an electric fireplace assembly. The electric fireplace assembly may have a front portion and a rear portion. According to this aspect of the invention, the electric fireplace assembly may include a plurality of logs and a front projector. The plurality of logs may include a first log extending along a first axis and a second log extending along a second axis. The first log and its first axis may be positioned closer to the front portion of the fireplace assembly than the second log and its second axis. The front projector is desirably for projecting light onto at least a portion of each of the first and second logs to provide the appearance of burning logs.

In accordance with further aspects of the invention, multiple front projectors may be provided. A rear projector may also be provided for projecting light onto a screen positioned toward or at the rear portion of the fireplace assembly, in order to provide the appearance of burning logs. In accordance with some aspects of the invention, that screen may be non-transparent. Moreover, multiple projectors of the fireplace assembly may be synchronized. For example, the front projector may include a front light source and a rotatable front spinner, and the rear projector may include a rear light source and a rotatable rear spinner. The front and rear spinners may be configured to reflect light from the respective front and rear light sources. In accordance with one aspect of the invention, the fireplace assembly may include a rotation control system for synchronizing rotation of the front and rear spinners In accordance with other aspects of the invention, the first log of the plurality of logs may have a first substantially planar surface facing the front of the fireplace assembly, and the front projector may be configured to project light onto at least a portion of that first substantially planar face, in order to provide the appearance of a burning log. Moreover, the first substantially planar surface of the first log may have a different color than other portions of that log. The second log of the plurality of logs may also have a second substantially planar surface facing the front of the fireplace assembly, and the front projector may be configured to project light onto at least a portion of the second substantially planar surface, in order to provide the appearance of a burning log. The front projector may be configured to project light onto at least a portion of an ember bed positioned below the logs. At least one of the logs may include a lighting source within it.

The electric fireplace assembly in accordance with any of the above aspects may further include a third log extending along a third axis. That third log may be positioned adjacent to the first log, such that the first and third logs define a first row positioned toward the front of the fireplace assembly with respect to the second log. The third axis of that third log may be transverse to the first axis of the first log. The electric fireplace assembly may further include a fourth log extending along a fourth axis. That fourth log may be positioned adjacent to the second log, such that the second and fourth logs define a second row positioned toward the rear of the fireplace assembly with respect to the first row. The fourth axis of that fourth log may be transverse to the second axis of the second log.

DETAILED DESCRIPTION

Figure 1:
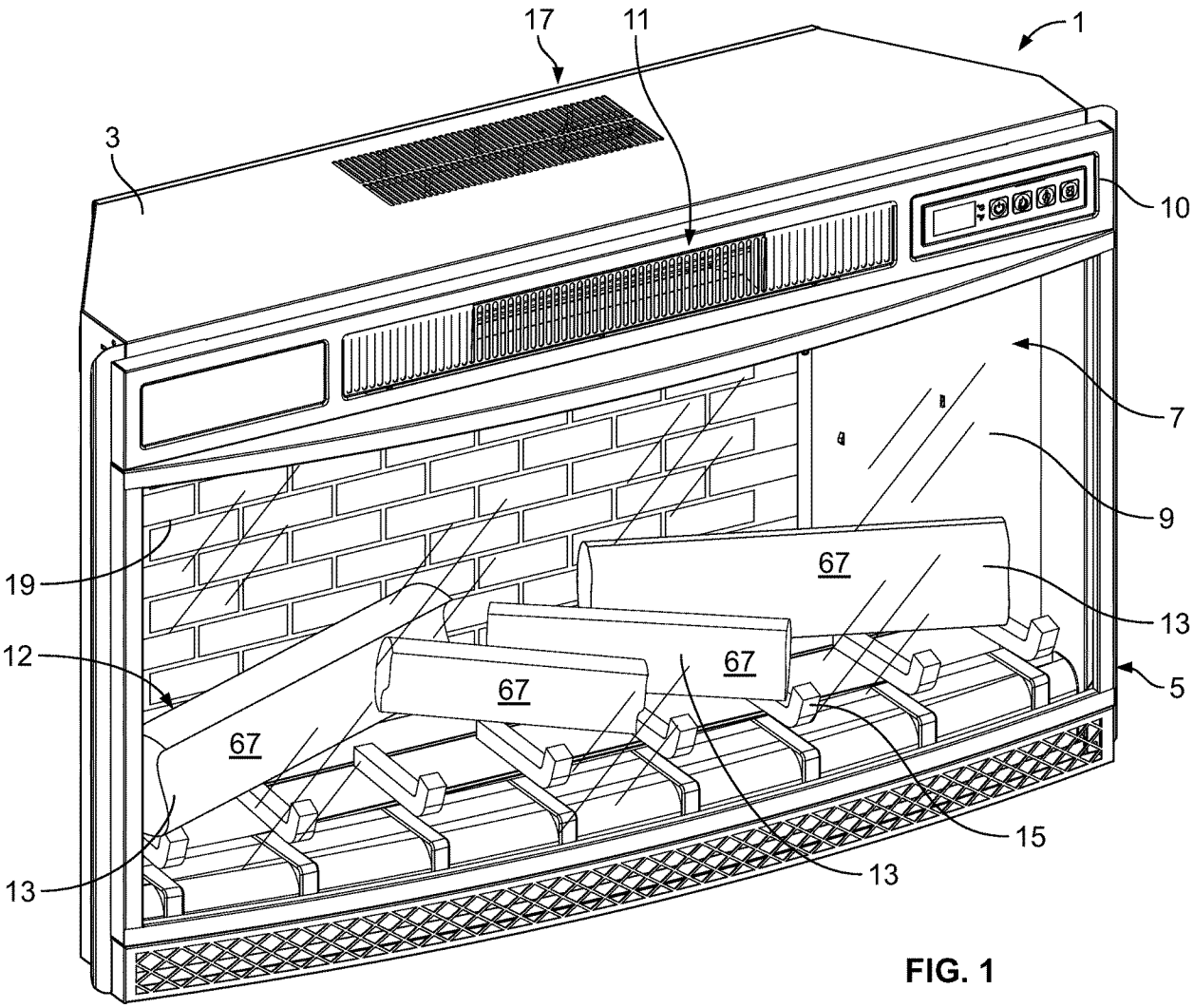
FIG. 1 is a front perspective view of an electric fireplace in accordance with an embodiment of the present invention.

FIG. 1 illustrates an electric fireplace 1 in accordance with an embodiment of the present invention. The electric fireplace 1 may be a freestanding component or it may include an insert configured to be received within another structure, such as a piece of furniture (e.g., a piece of cabinetry) or an opening in a wall of a building, or even within the firebox of a traditional fireplace. The electric fireplace 1 includes a housing 3 defining an interior volume. The front 5 of the electric fireplace 1 includes a main opening 7. An at least partially translucent or transparent structure, such as a window pane 9 may be positioned in the opening 7.

The electric fireplace 1 may include controls 10 for controlling the operation of the fireplace 1. Also, the electric fireplace 1 may also include another opening with a grill 11 arranged above the main opening 7, to direct heat out of the electric fireplace 1 to heat the area located in proximity to the fireplace. In that way, the electric fireplace 1 may function as a heater and may provide at least some of the heat provided by a wood or other fuel-burning fireplace. As shown in FIG. 1, the controls 10 and the grill 11 may both be located on the front 5 of the fireplace 1, for example above the main opening 7.

Inside the interior volume of the electric fireplace 1 is a log set 12, which may include one or more logs 13 positioned on a grate 15. The logs 13 are preferably artificial, although they may be real wood logs, and the logs 13 may be structured so as to mimic real wood logs. Typical materials for the logs 13 include polymers, ceramic, metal, glass and wood (although other materials may also be used), and the logs 13 may be colored (e.g., painted, dyed, etc.) so that their exterior surfaces mimic the appearance and color of real wood logs.

Figure 2:
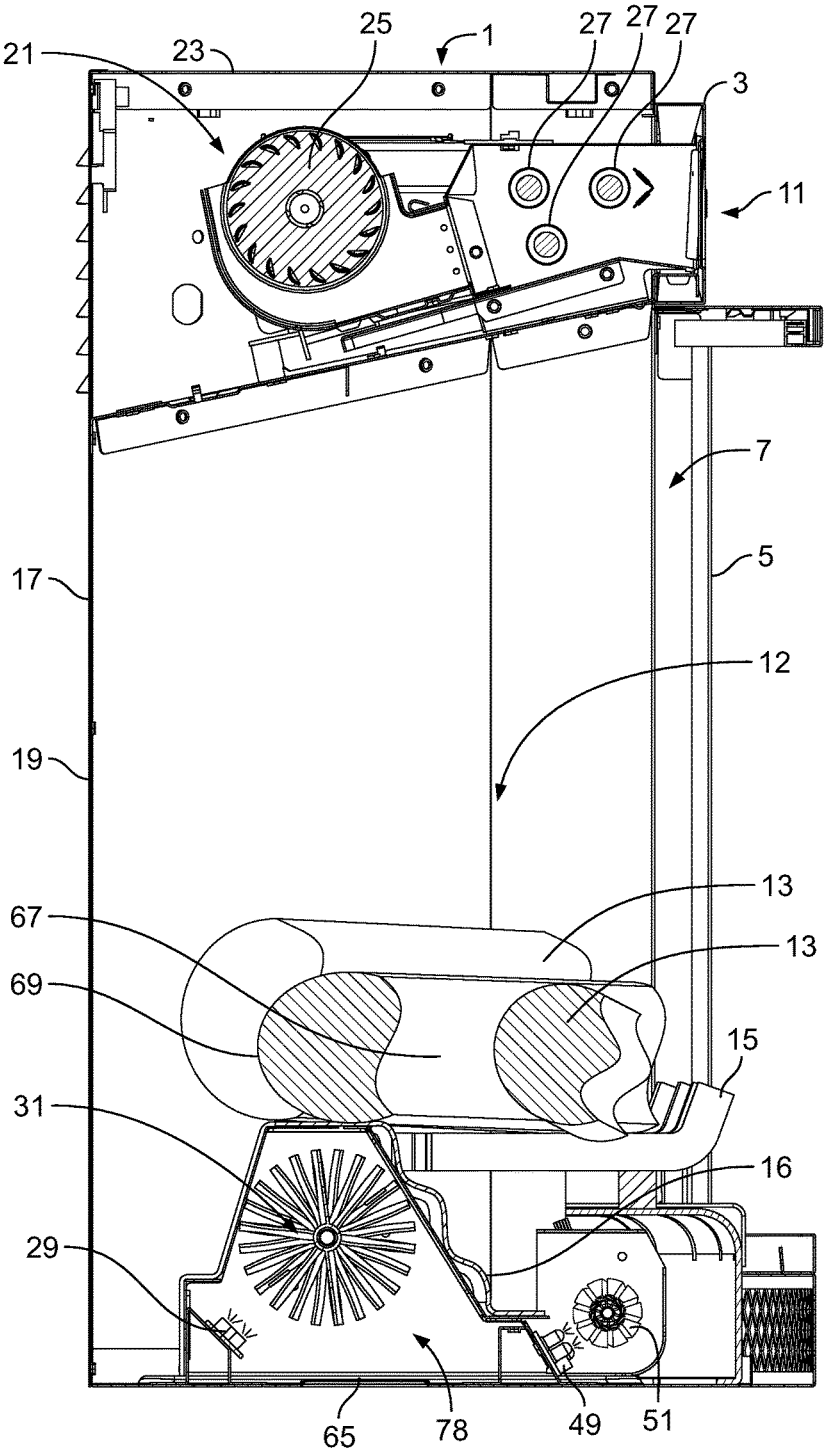
FIG. 2 is a side sectional view of the electric fireplace of FIG. 1.

As shown in FIG. 2, an ember bed 16 is preferably arranged below the log set 12, which can create the appearance of glowing embers and/or burned ash in a traditional, wood-burning fireplace. The ember bed 16 may be constructed of polymer, ceramic, metal, glass, or other material, and may be colored so that its exterior surface appears as real glowing embers and/or burned ash. Behind the log set 12, at the rear 17 of the housing 3, is a rear wall 19. The rear wall 19 preferably has a solid (non-transparent) appearance and may include a design for visual interest, such as a design which creates the appearance of the inside of a traditional fireplace. For example, as shown in FIG. 1, the design may include a brick pattern. Other interior walls 20 may also include the same or different designs, as shown in the embodiment illustrated in FIG. 11B.

Turning to the cross-sectional view in FIG. 2, a heater 21 is arranged near the top 23 portion of the housing 3. The heater 21 may be a convection heater that blows heated air out of one or more openings in the electric fireplace 3, such as the grill 11 on the front 5 illustrated in FIG. 1. The heater 21 may include a fan, such as a centrifugal fan or blower 25, for moving air past one or more heating elements 27 to heat the air before it exits the grill 11. The heater 21 need not be a convection heater, however, and any other suitable heater for providing desired warmth to the area located in proximity to the fireplace may be used, such as a radiant heater.

Figure 4:
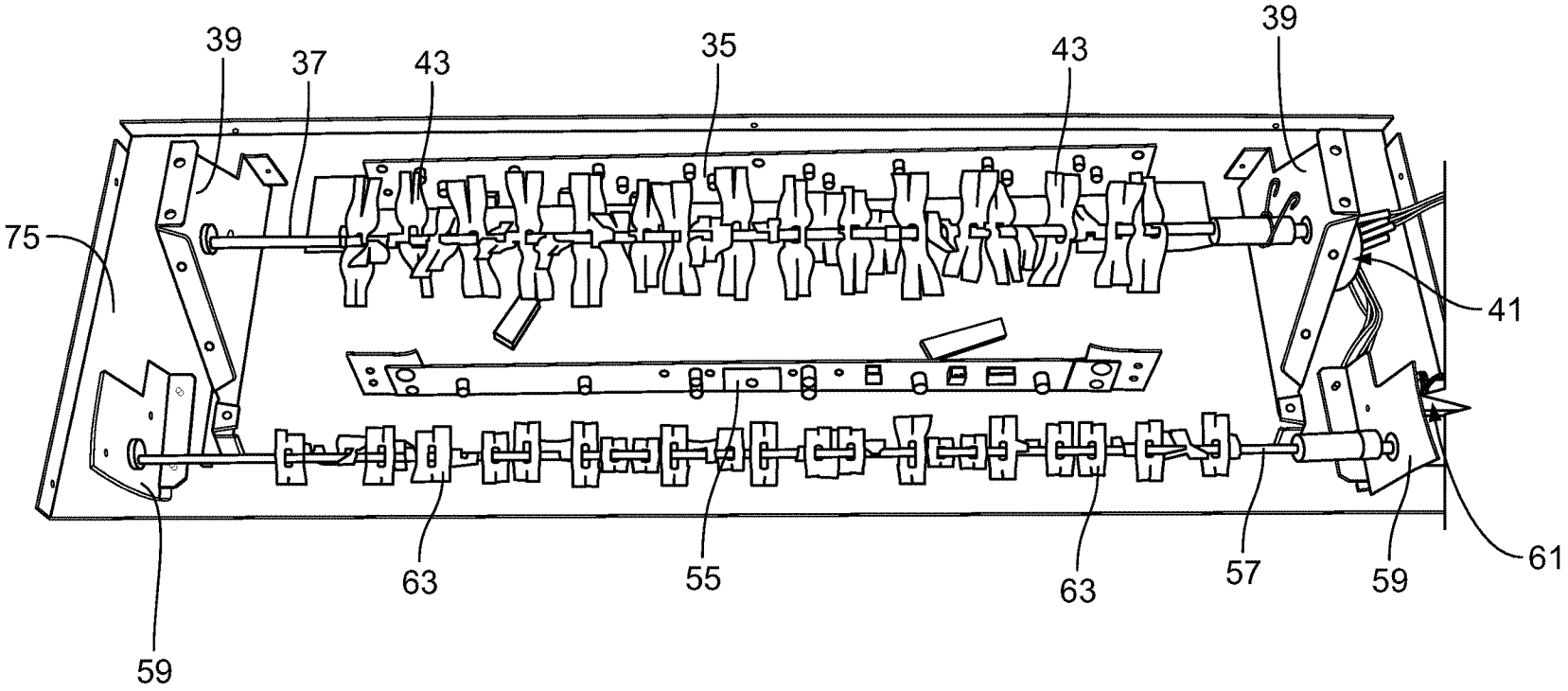
FIG. 4 is a top perspective view of a sub-assembly of components of an electric fireplace in accordance with an embodiment of the present invention, taken from the front.
Figure 5:
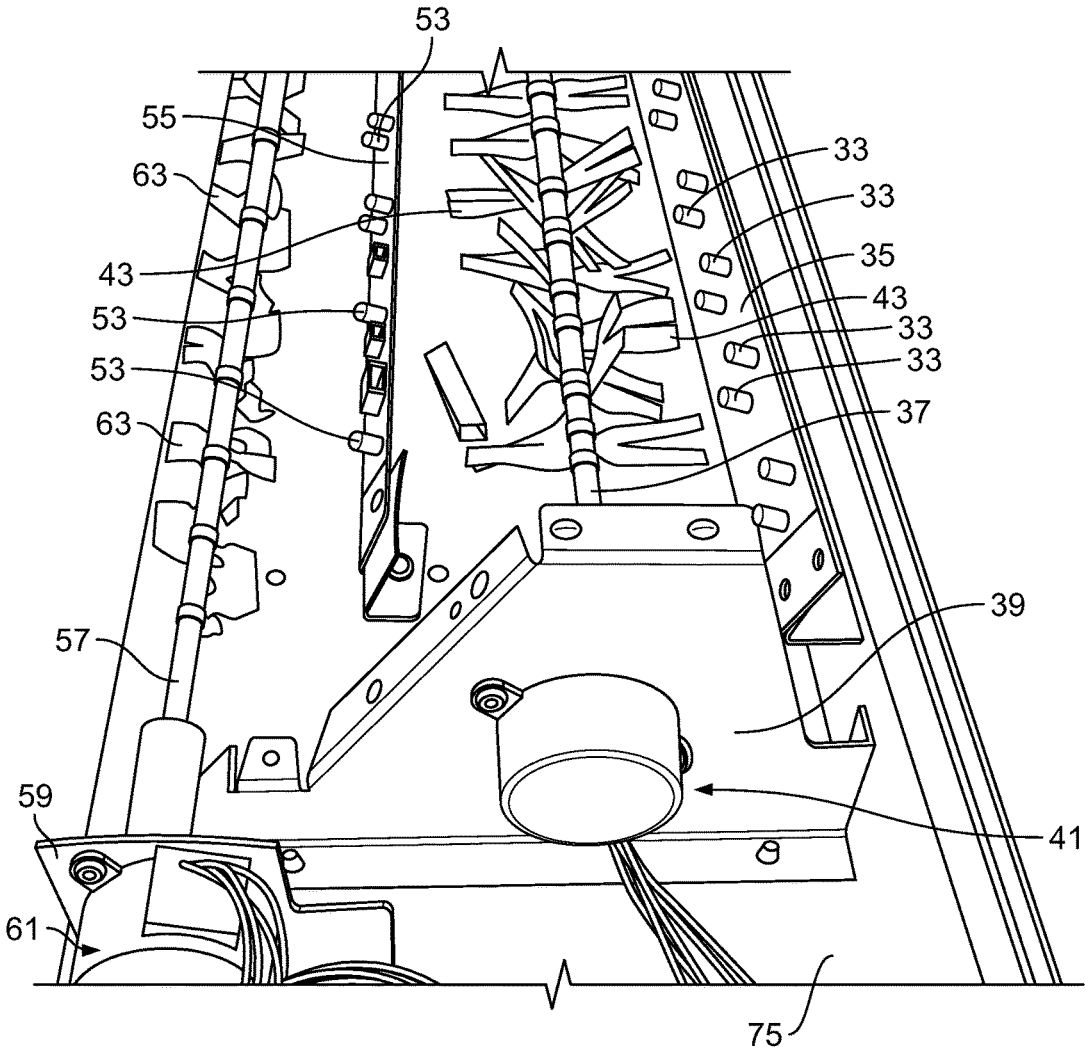
FIG. 5 is an enlarged, top perspective view of a portion of the sub-assembly of FIG. 4, taken from the side.

Also inside the housing 3 of the electric fireplace 1, is a lighting system that simulates aspects of the illumination patterns observed in wood or other fuel-burning fires. For example, the lighting system may include a rear projector for projecting lighting effects onto a screen behind the log set 12. Alternatively, the rear wall 19 may function as such a screen. The rear projector may include a rear light source 29 and a rear spinner 31. As shown in FIGS. 4-5, the rear light source 29 may include an array of lights 33, such as LEDs, supported by a supporting structure 35 (such as a printed circuit board). Other types of lights may be used without limitation, however, including, for example, incandescent, fluorescent and halogen lights. The lights may be colored (or they may have multiple colors) in order to mimic the colors emitted by a real, fuel-burning fire. As also shown in FIGS. 4-5, the rear spinner 31 includes a central axle 37 that is supported at least at one end by a support 39, but desirably has supports 39 at each end, and is rotationally driven about the axle 37 by a motor 41. A plurality of strips 43 of at least partially reflective material radiate outwardly from the axle 37 along its length. Those strips 43 may each extend outwardly from the axle 37 along a variety of twisting and/or undulating paths, and/or their peripheral edges may have a variety of curving profiles.

Figure 3:
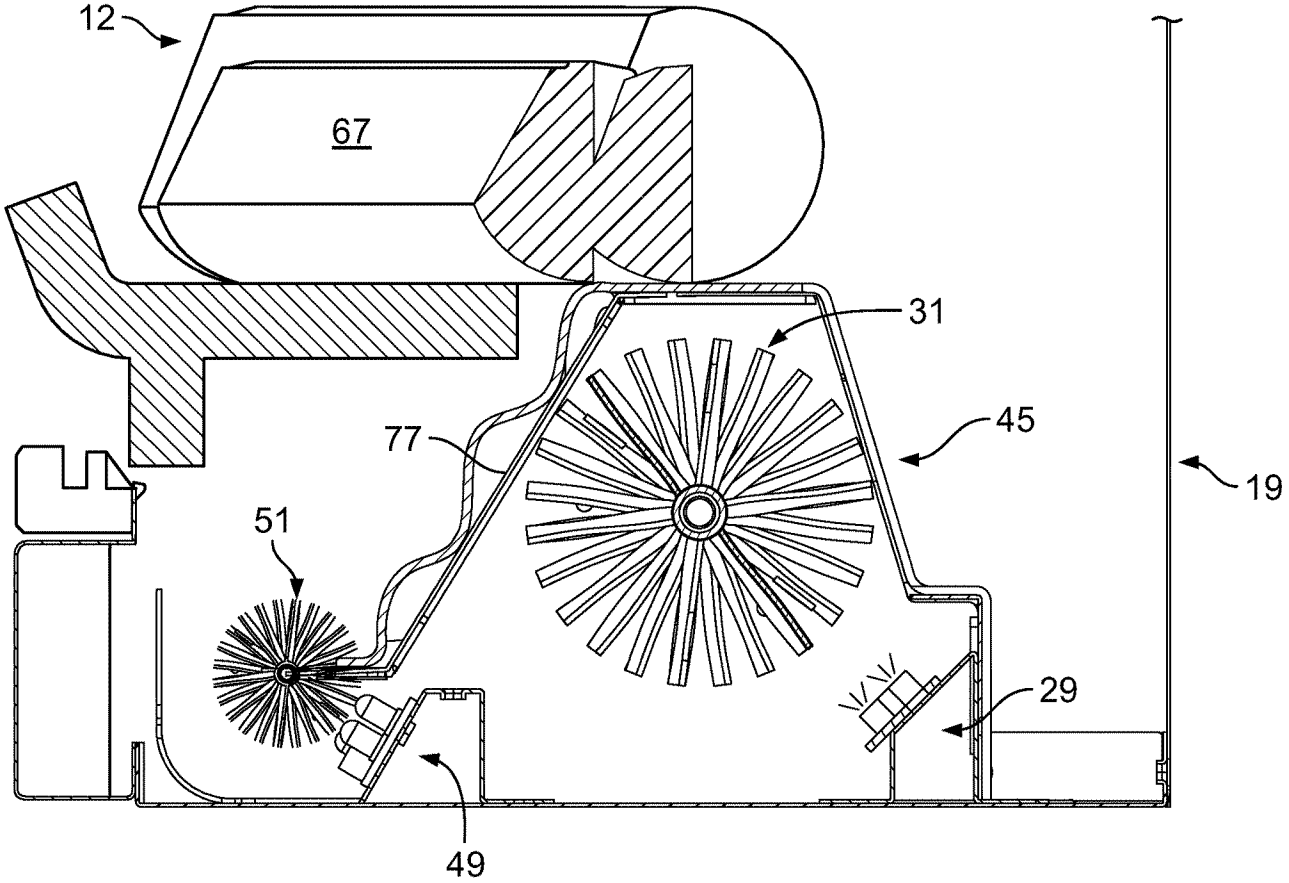
FIG. 3 is a simplified, enlarged side sectional view of the electric fireplace of FIG. 1.
Figure 6:
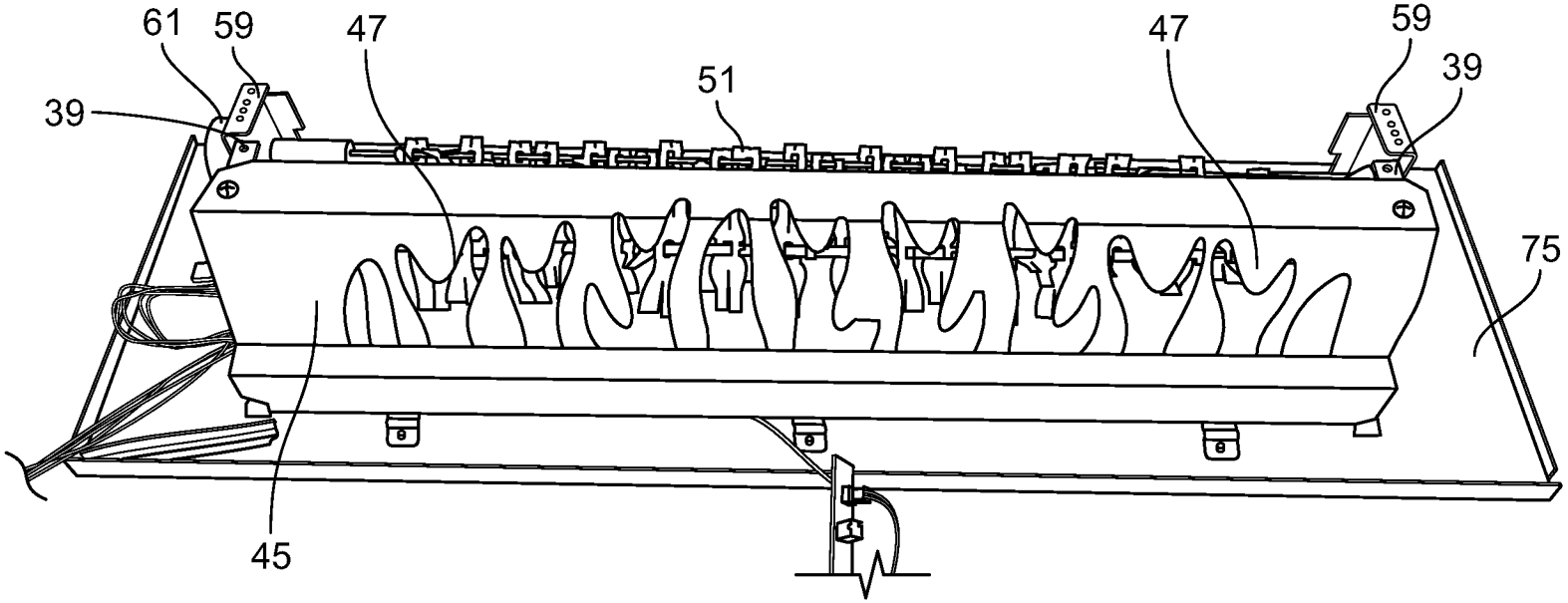
FIG. 6 is a top perspective view of another sub-assembly of components of the electric fireplace of FIG. 4, taken from the rear.

As shown in FIG. 3, the rear light source 29 and rear spinner 31 are desirably arranged so that light emanating from the rear light source 29 reflects at least partially from the strips 43 of the rear spinner 31 and is projected onto the rear screen 19, which may be non-transparent. By rotating the rear spinner 31 about its central axle 37, the projected light on the rear screen 19 will desirably move and/or flicker similarly to light emanating from a real fuel-burning fire. A flame-shaping template 45 may also be provided between the rear spinner 31 and the rear screen 19 in order to shape the light projected onto the rear screen 19. As shown in FIG. 6, that template 45 may be a panel having flame-shaped cutouts 47 that permit light to pass through them.

The lighting system may also include a front projector for projecting lighting effects onto one or more of the logs 13 and/or the ember bed 16. The front projector may include a front light source 49 and a front spinner 51. As shown in FIGS. 4-5, the front light source 49, like the rear light source 29, may include an array of lights 53 (such as LEDs) supported by a supporting structure 55 (such as a printed circuit board). As with the rear light source 29, other types of lights may be used in the front light source 49 without limitation, including, for example, incandescent, fluorescent, and halogen lights. The lights may also be colored, and they may have multiple colors, in order to mimic the colors emitted by a real, wood or other fuel-burning fire. As also shown in FIGS. 4-5, the front spinner 51 includes a central axle 57 that is supported at least at one end by a support 59, but desirably has supports 59 at each end, and is rotationally driven by a motor 61. The central axle 57 includes a plurality of light-reflecting strips 63 of at least partially reflective material along its length. Those strips 63 may have similar or identical shapes to those discussed above in connection with the rear spinner 31.

In one embodiment, as shown in FIGS. 2-5, the front and rear spinners have similar structures, but the front spinner 51 has a smaller diameter (as defined by the radial extent of the strips 63) than that of the rear spinner 31, and the central axle 57 of the front spinner 51 may be positioned closer to the bottom 65 of the fireplace housing 3 than that of the rear spinner 31. As shown in FIG. 3, the front light source 49 and front spinner 51 are desirably arranged so that light emanating from the front light source 49 reflects at least partially off of the strips 63 of the front spinner 51 and is projected onto the logs 13 and/or ember bed 16. By rotating the front spinner 51 about its central axle 57, the projected light on the logs 13 and/or ember bed 16 will desirably move and/or flicker similarly to light created by a wood-burning fire.

A log set 12 in accordance with preferred embodiments of the present invention desirably includes a plurality of logs 13, such as four logs shown in FIG. 1. Desirably, at least one of those logs 13 includes at least one substantially planar face 67 extending along its longitudinal axis such that the log 13 mimics a natural log which has been split in the longitudinal direction. Preferably, the log 13 is oriented such that the substantially planar face 67 faces in a generally forwards direction towards the front 5 of the fireplace 1. In that way, desirably the planar face 67 acts somewhat like a projection screen that it is better adapted to receive the light projected from the front spinner 51 than the more curved surfaces 69 of the other portions of the log 13. The substantially planar face 67 of the log 13 would preferably not define a completely flat plane, but rather would extend generally along a plane, particularly in comparison to the more curved surfaces 69 of the other portions of the log 13. Indeed, like natural logs that have been split along their longitudinal dimensions, the substantially planer face 67 would preferably at least have linear ridges extending in the longitudinal direction, similar to the longitudinal fibers of a natural split log. Moreover, the surface 67 would also preferably deviate at least slightly from the plane along which it extends at one or more locations, so as to resemble the imperfections of a natural split log face. Furthermore, to better resemble a natural split log, the log 13 is desirably colored (e.g., painted, dyed, etc.) differently in different locations. For example, the substantially planar face 67 may include a different color than the color of the more curved surfaces 69. In that way, the log 13 may mimic the natural color differences in natural logs, which often have outer, curved surfaces that are covered with bark having a different color than the color of the interior of the log that is exposed when the log is split. For some logs, the interior is a lighter color than the color of the bark. For other logs, such as those from birch trees, a split log may include an interior with a beige tone while the exterior curved surface is covered with a white bark. Regardless of the color difference, the planar face 67 of the log 13 may function better as a projection screen for the light projected from the front spinner 51 than the more curved surfaces 69 of the other portions of the log 13. In some instances, logs that have a lighter color on the substantially planar face 67 may more effectively display the light projected onto it by the front spinner 51.

Figure 9:
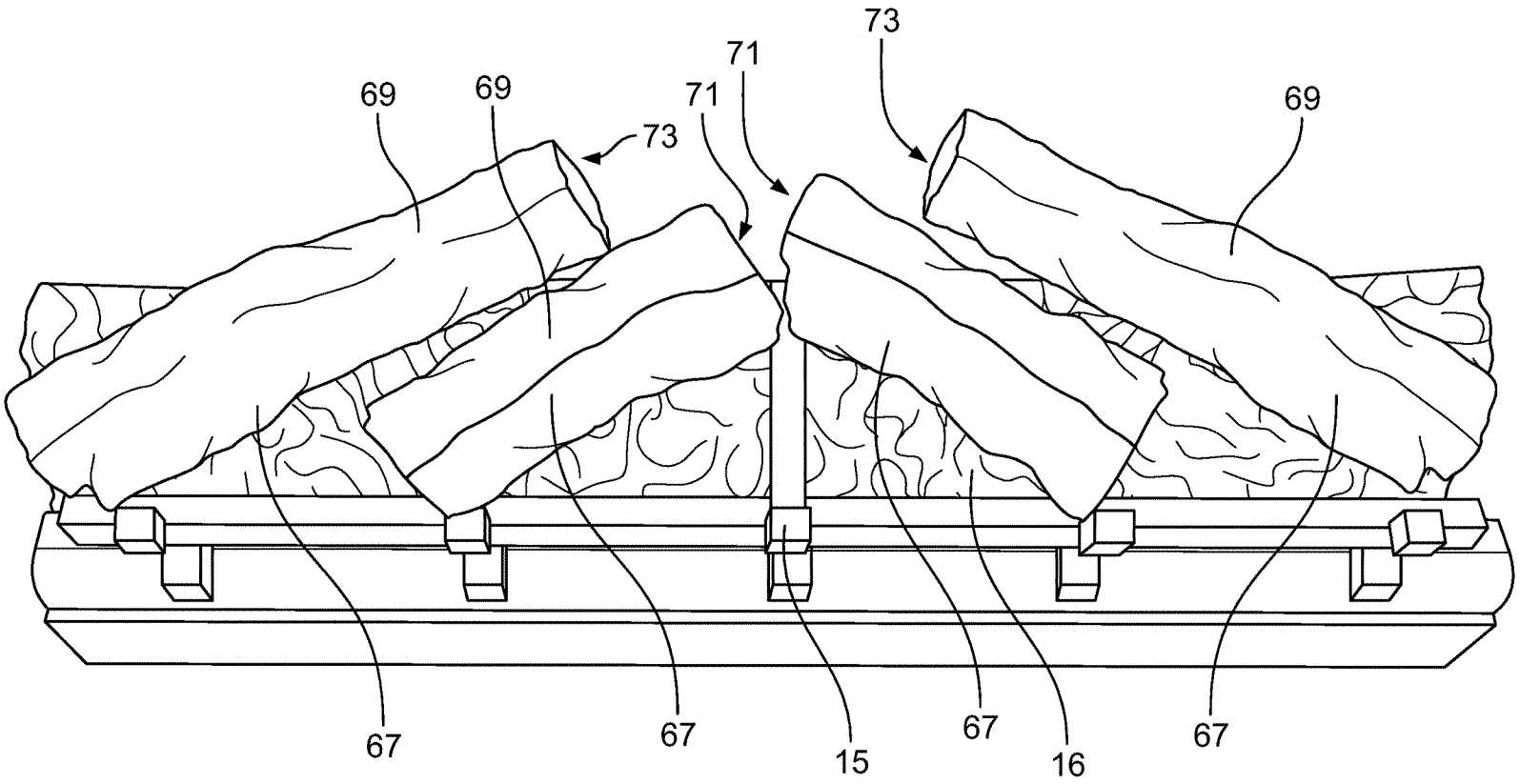
FIG. 9 is a top perspective view of a different sub-assembly of components of the electric fireplace of FIG. 4, taken from the front.
Figure 10:
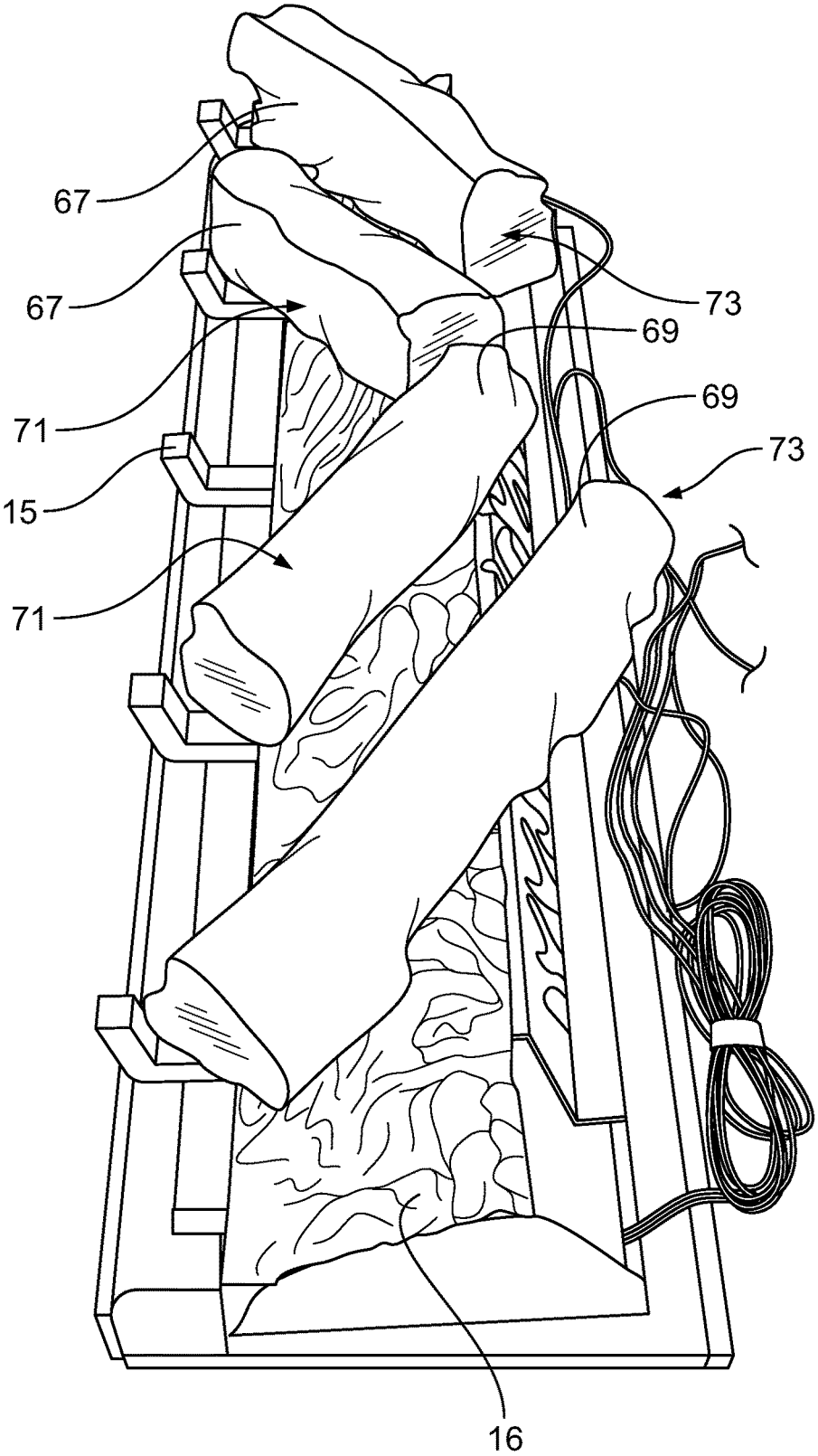
FIG. 10 is a top perspective view of the sub-assembly of FIG. 9, taken from the side.

Desirably, the logs 13 of the log set 12 in accordance with preferred embodiments of the present invention extend at different angles to one another. For example, as shown in the embodiment of the log set 12 illustrated in FIG. 1, as well as the embodiment of the log set illustrated in FIGS. 9-10, the logs 13 extend along longitudinal axes that are transverse to one another. Alternatively, or additionally, the logs 13 may be generally arranged in multiple rows. For example, as shown in the embodiment of FIGS. 9-10, the log set 12 may include two logs 13 in a first row 71 which is positioned more towards the front 5 of the fireplace 1 (e.g., closer to transparent pane 9) than the logs 13 in a second row 73. Desirably at least one log in each row may be a split log having a substantially planar face 67, with the face 67 facing in a generally forwards direction towards the front 5 of the fireplace 1, as discussed above. For example, all of the logs 13 in the log set 12 may have such forwardly facing substantially planar faces 67. The logs 13 in one or more rows may also be transverse to other logs 13 in the same row. For example, as shown in FIGS. 9-10, the two logs 13 in the first row 71 are oriented so that their substantially planar faces 67 angle slightly towards one another. Similarly, the two logs 13 in the second row 73 are oriented so that their forward-facing planar faces 67 are also angled slightly towards one another.

Desirably, the above-discussed features of the preferred embodiments of the invention, and particularly combinations of multiple such features, give the log set 12 and the simulated fire a more natural, three-dimensional appearance. In that regard, having a log set 12 in which at least one of the logs 13 has a forwardly-facing, substantially planar face 67 for receiving flame-mimicking light projected from the front projector, particularly in combination with a non-transparent rear wall 19 or screen behind the logs 13 that receives flame-mimicking light projected from the rear projector, desirably provides a realistic three-dimensional flame effect in conjunction with a log set having a natural, split-log appearance. Moreover, providing an arrangement of a plurality of logs 13 in the log set 12 that extend in different, transverse orientations, and also are positioned in front of or behind one another, will add to the three-dimensional flame effect when the front projector projects flame-mimicking light on multiple ones of those differently positioned logs 13.

To further add to the lighting effects and increase the realism of the simulation, one or more of the logs 13 in the log set 12 may be at least somewhat translucent and may include one or more internal lights such that the log(s) 13 appear to glow. The ember bed 16 may similarly be at least somewhat translucent, and one or more lights may be included below the ember bed 16 such that it appears to glow as in the case of a real wood fire.

Figure 7:
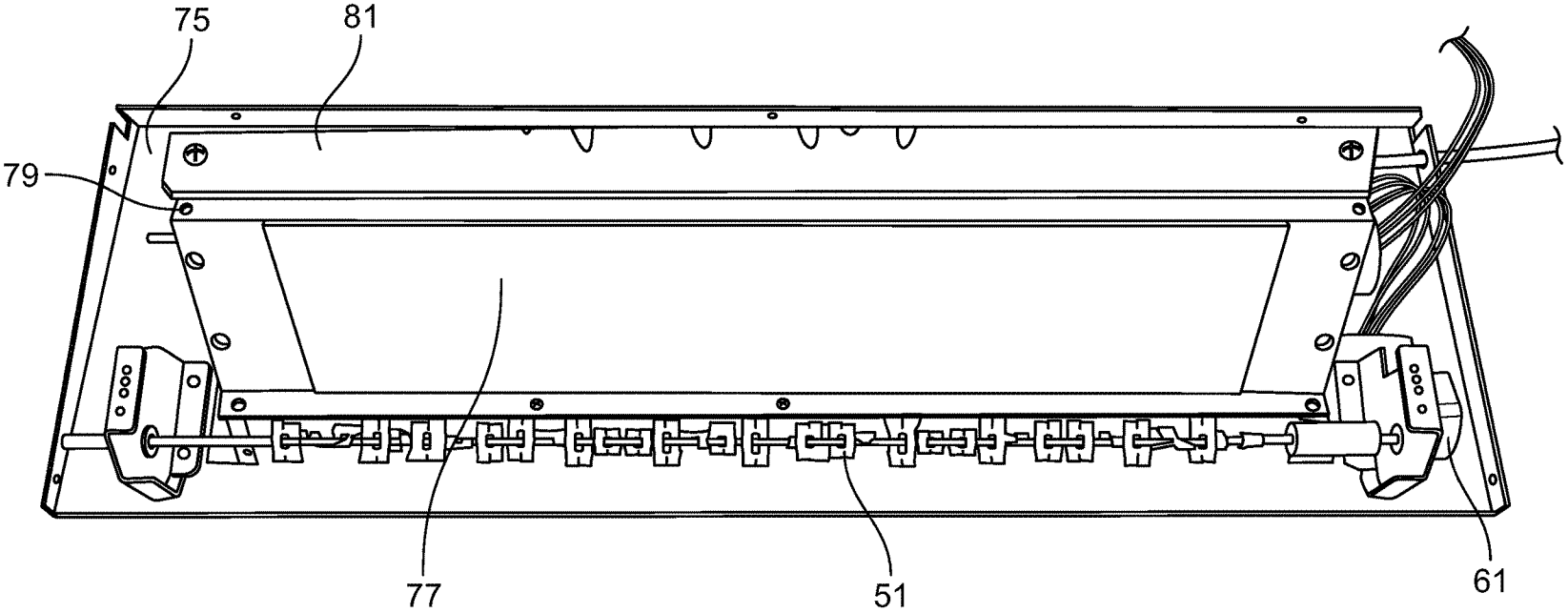
FIG. 7 is a top perspective view of yet another sub-assembly of components of the electric fireplace of FIG. 4, taken from the front.
Figure 8:
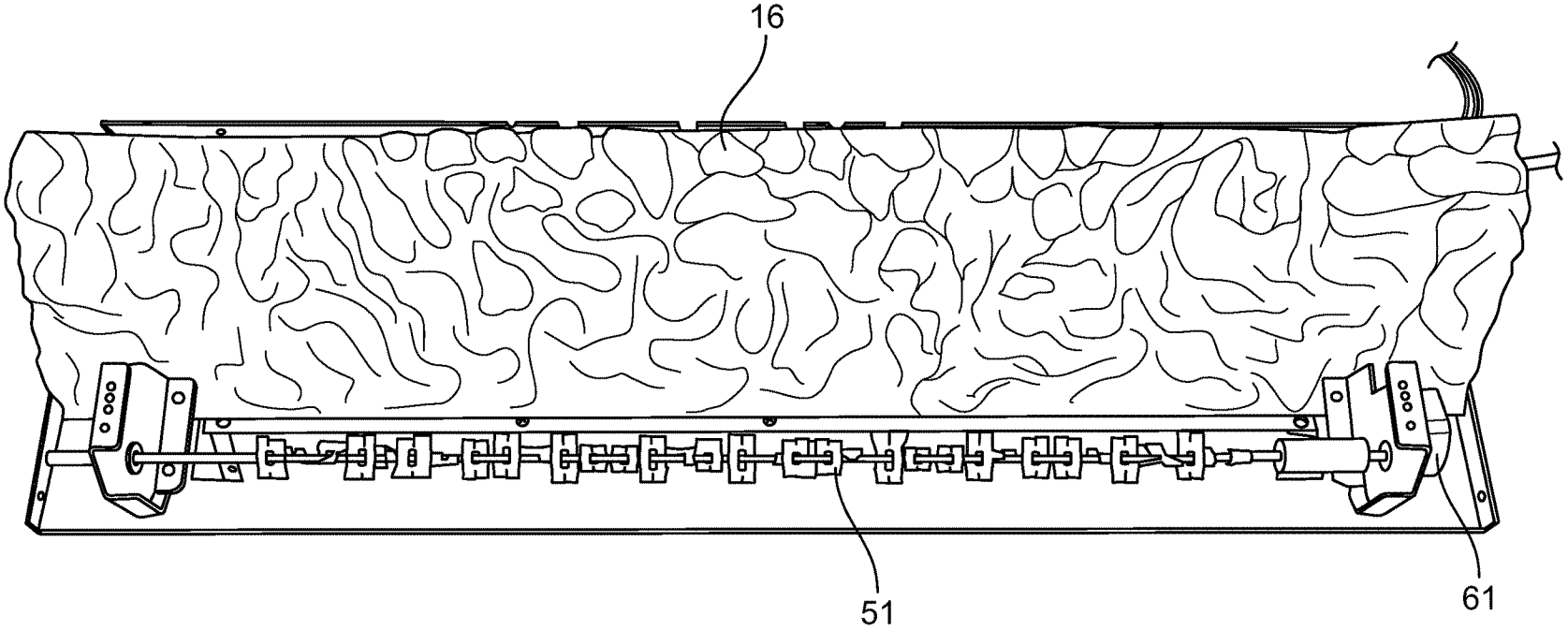
FIG. 8 is a top perspective view of a further sub-assembly of components of the electric fireplace of FIG. 4, taken from the front.

Various steps in the assembly of one embodiment of the present invention are illustrated in FIGS. 4-10. For example, a baseplate 75 to be positioned at the bottom 65 of the housing 3 may first be assembled with the rear light source 29, rear spinner 31, front light source 49, and front spinner components 51, as shown in FIGS. 4-5. Then, a flame-shaping template 45 may be provided to the rear of the rear spinner 31, as shown in FIG. 6. A panel 77 may then be provided between the rear spinner 31 and the front light source 49, which panel 77 may be attached along its top end 79 to the top 81 of the flame-shaping template 45, as shown in FIG. 7. In that way, the panel 77 and flame-shaping template 45 may define an enclosure 78 around the rear light source 29 and rear spinner 31, as shown in FIG. 3. In order to reduce errant reflections and/or prevent the light of the rear light source 29 from escaping towards the front 5 of the fireplace 1 past the panel 77, the panel 77 is desirably dark colored, non-reflective, and/or does not transmit light through it. A preferred material for the panel 77 may be rubber. After the panel 77 is secured, the ember bed 16 may be positioned over the panel 77, as shown in FIG. 8. The log set 12 may then be positioned on top of the ember bed 16 and the enclosure 78, as shown in FIGS. 9-10. The baseplate 75 with the above-discussed components attached to it may then be positioned within the housing 3 of the electric fireplace 1.

Figure 11:
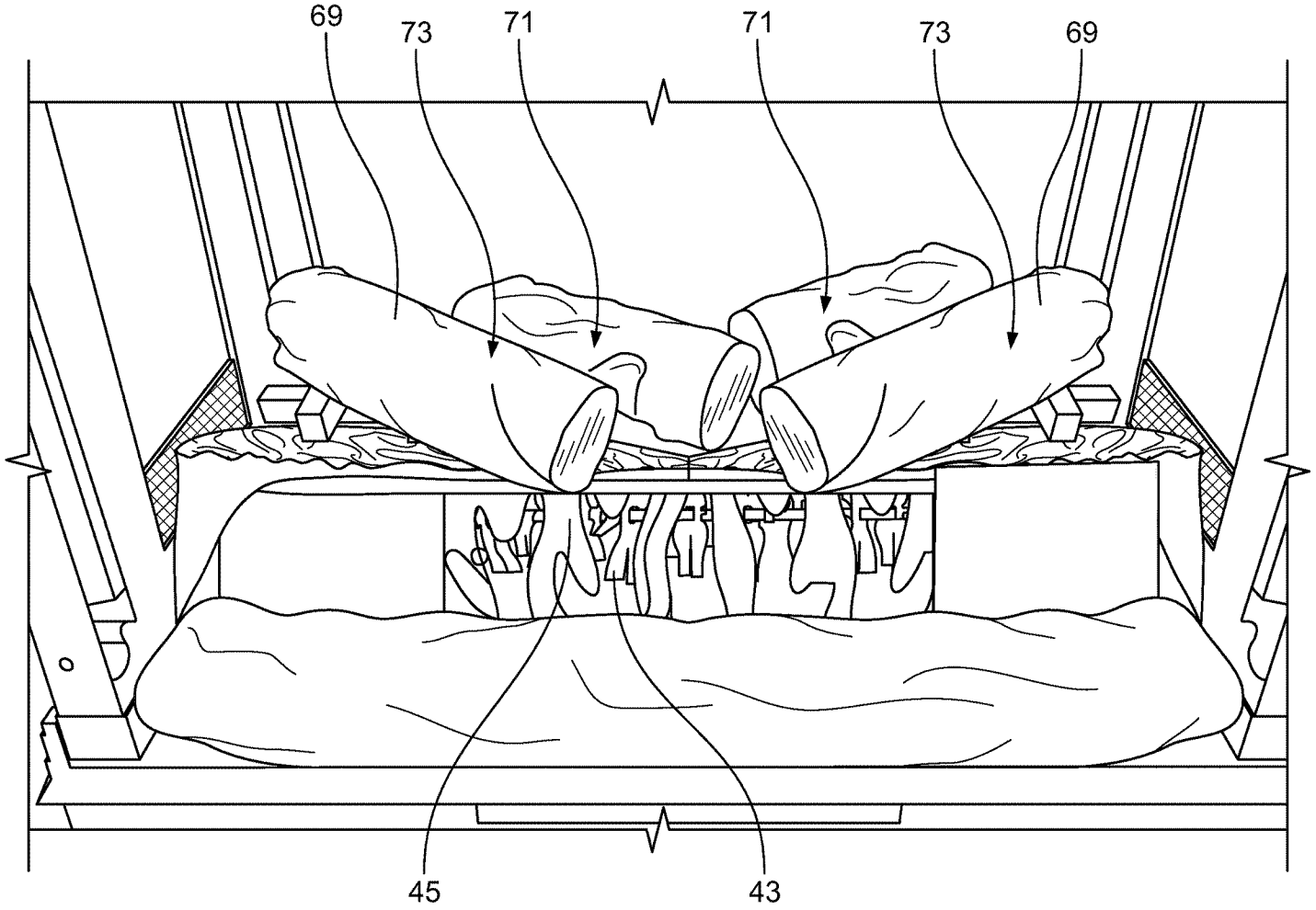
FIG. 11 is a rear perspective view of the sub-assembly of FIG. 9 in operation.
Figure 12A:
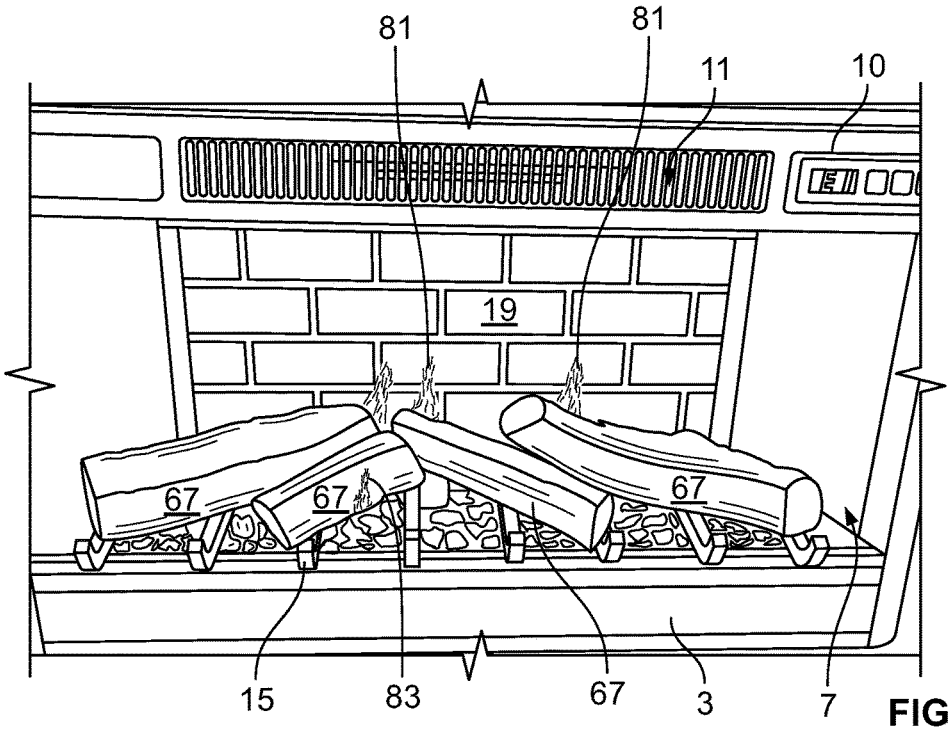
FIGS. 12A and 12B are front perspective views of electric fireplaces, in accordance with two different embodiments of the present invention, in operation.
Figure 12B:
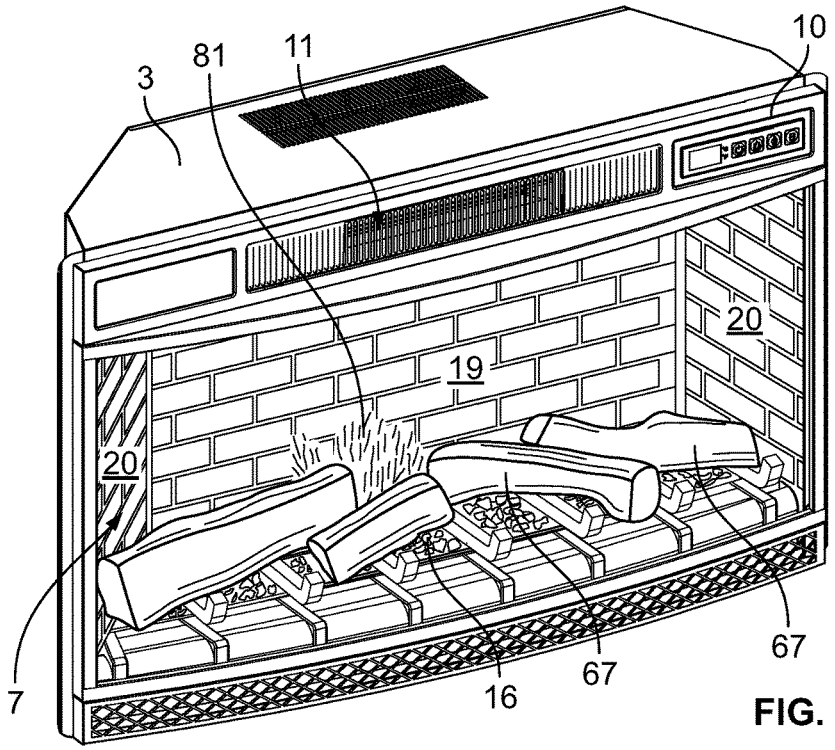

In operation, the rear projector may be operated to project flame shaped light 81 on the rear screen 19, as shown in the illustrations of FIGS. 12A-B, and that light 81 may flicker and/or move, for example based on the rotation of the rear spinner 31, as discussed above. As shown in FIG. 11, the reflected light from the illuminated strips 43 of the rear spinner 31 may pass through the flame-shaping template 45 before being projected on the rear screen 19. As also shown in FIGS. 12A-B, light 83 may be projected onto the substantially planar surfaces 67 of the logs 13 in the log set 12, which light 83 may also flicker and/or move, as discussed above, in order to simulate a real wood-burning fire.

In accordance with other embodiments of the invention, the lighting system may include multiple front projectors. Some such embodiments may include multiple rows of front projectors, for example with each row corresponding to a respective row of logs. That is, each row of front projectors can be positioned such that the light from the projector (e.g., the reflected light from the spinner) is directed onto its own associated row of logs. Such embodiments may provide added depth to the flame simulation. In other such embodiments, multiple front projectors may be provided with at least one being associated with its own log. For example, particularly where multiple logs within a particular row are significantly angled with respect to one another, multiple front projectors may be provided where each projector is associated with its own log, so as to provide optimal lighting projection onto each log. Each such projector may, for example, be aligned with the respective log, such that the spinner and the light source extend substantially parallel to the longitudinal axis of the associated log.

In accordance with yet further embodiments of the invention, multiple lighting projectors may be coordinated, e.g., such that it looks like a flame starts on one of the logs and then continues up onto the rear screen. For example, a rotation control system may synchronize the rotation of the front spinner 51 and rear spinner 31 so as to create that or other lighting effects. One example of such a rotation control system may include a physical interconnection (e.g., a chain or belt drive) between the front spinner 51 and the rear spinner 31. In such an example, a pulley on each axle 37, 57 of the rear and front spinners 31, 51, respectively, may be interconnected with a belt, or a sprocket on each axle of the front and rear spinners may be interconnected with a chain, so that both axles rotate together. In such an embodiment, one of the front or rear motors 41, 61 may be eliminated, such that both spinners 31, 51 are controlled by a single motor via the interconnecting belt or chain. Alternatively, both front and rear motors 41, 61 may be eliminated, and a single motor may be provided that drives the interconnecting belt or chain directly, so as to induce synchronized rotation of both spinners 31, 51. Another example of a rotation control system may include electronic control of the rotation of the front and rear spinners 51, 31. For example, the control system that controls each motor 41, 61 may be programmed to synchronize the rotation of both spinners. In such an example, the motors may be stepper motors or servomotors, so that their rotation can be precisely controlled. Alternatively, or additionally, the axles 37, 57 and/or the motors 41, 61 may include rotary encoders, so that their rotational position can be monitored and controlled by the control system.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An electric fireplace assembly having a front and a rear, the fireplace assembly comprising:

a plurality of logs wherein at least one of the logs has a substantially planar surface facing the front of the fireplace assembly, wherein the front comprises a pane through which the plurality of logs are viewable;

a non-transparent screen positioned behind the plurality of logs toward or at the rear of the fireplace assembly;

a front projector for projecting light onto at least a portion of the substantially planar surface of the at least one log to provide the appearance of a burning log;

a rear projector for projecting light onto the screen to provide a further appearance of a burning log; and an ember bed positioned between the front projector and the rear projector.

2. The fireplace assembly of claim 1, wherein the plurality of logs includes a first log extending along a first axis and a second log extending along a different, second axis.

3. The fireplace assembly of claim 2, wherein the first and second axes are transverse to one another.

4. The fireplace assembly of claim 2, wherein the first axis is positioned toward the front of the fireplace assembly with respect to the second axis.

5. The fireplace assembly of claim 2, wherein the second log has a second substantially planar surface facing the front of the fireplace assembly, and wherein the front projector is configured to provide the appearance of a burning log onto at least a portion of the second substantially planar surface.

6. The fireplace assembly of claim 1, wherein the front projector is configured to project light onto at least a portion of an ember bed positioned below the plurality of logs.

7. The fireplace assembly of claim 1, wherein the front projector includes a front light source and a rotatable front spinner, the front spinner being configured to reflect light from the front light source onto the substantially planar surface of the at least one log; wherein the rear projector includes a rear light source and a rotatable rear spinner, the rear spinner being configured to reflect light from the rear light source onto the screen; and wherein the fireplace assembly further includes a rotation control system configured to synchronize rotation of the front and rear spinners.

8. The fireplace assembly of claim 1, wherein the substantially planar surface of the at least one of the plurality of logs comprises a different color than other portions of the first log.

9. An electric fireplace assembly having a front and a rear, the fireplace assembly comprising:

a plurality of logs, including a first log extending along a first axis and a second log extending along a second axis, wherein the first log and the first axis are positioned closer to the front of the fireplace assembly than the second log and the second axis wherein at least one of the plurality of logs has a substantially planar surface and a non-substantially planar surface, wherein the front comprises a pane through which the plurality of logs are viewable; and a front projector for projecting light onto at least a portion of each of the first and second logs to provide the appearance of burning logs, where the projected light is exterior to an ember bed.

10. The fireplace assembly of claim 9, further comprising a rear projector for projecting light onto a screen positioned toward or at the rear portion of the fireplace assembly to further provide the appearance of burning logs.

11. The fireplace assembly of claim 10, wherein the screen is non-transparent.

12. The fireplace assembly of claim 10, wherein the front projector includes a front light source and a rotatable front spinner, the front spinner being configured to reflect light from the front light source onto each of the first and second logs; wherein the rear projector includes a rear light source and a rotatable rear spinner, the rear spinner being configured to reflect light from the rear light source onto the screen; and wherein the fireplace assembly further includes a rotation control system configured to synchronize rotation of the front and rear spinners.

13. The fireplace assembly of claim 9, wherein the first log has a first substantially planar surface facing the front of the fireplace assembly, and wherein the front projector is configured to project light onto at least a portion of the first substantially planar face to provide the appearance of a burning log.

14. The fireplace assembly of claim 13, wherein the first substantially planar surface of the first log comprises a different color than other portions of the first log.

15. The fireplace assembly of claim 13, wherein the second log has a second substantially planar surface facing the front of the fireplace assembly; and wherein the front projector is configured to project the light onto at least a portion of the second substantially planar face to create the appearance of a burning log.

16. The fireplace assembly of claim 9, wherein the front projector is configured to project the light onto at least a portion of an ember bed positioned below the plurality of logs.

17. The fireplace assembly of claim 9, further comprising a third log extending along a third axis, the third log being positioned adjacent to the first log such that the first and third logs define a first row positioned toward the front of the fireplace assembly with respect to the second log.

18. The fireplace assembly of claim 17, wherein the third axis is transverse to the first axis.

19. The fireplace assembly of claim 17, further comprising a fourth log extending along a fourth axis, the fourth log being positioned adjacent to the second log such that the second and fourth logs define a second row positioned toward the rear of the fireplace assembly with respect to the first row.

20. The fireplace assembly of claim 19, wherein the fourth axis is transverse to the second axis.

* * * * *